US007624975B2

(12) United States Patent
Reeves et al.

(10) Patent No.: US 7,624,975 B2
(45) Date of Patent: Dec. 1, 2009

(54) MECHANISM FOR RETAINING A STACK OF SHEETS IN A COMPILER TRAY, SUCH AS FOR AUTOMATIC STAPLING

(75) Inventors: Robert James Douglas Reeves, Toronto (CA); Mark Sparano, Toronto (CA); Giovanni Forte, Toronto (CA); Martyn Mitchell, Milton (CA)

(73) Assignee: Xerox Corporation, Norwalk, CT (US)

( * ) Notice: Subject to any disclaimer, the term of this patent is extended or adjusted under 35 U.S.C. 154(b) by 1224 days.

(21) Appl. No.: 10/850,542

(22) Filed: May 20, 2004

(65) Prior Publication Data

US 2005/0258585 A1 Nov. 24, 2005

(51) Int. Cl.
*B65H 37/04* (2006.01)

(52) U.S. Cl. ..... 270/58.12; 270/58.16

(58) Field of Classification Search ..... 270/58.08, 270/58.09, 58.12, 58.16; 271/220
See application file for complete search history.

(56) References Cited

U.S. PATENT DOCUMENTS 5,284,337 A * 2/1994 Ettischer et al. ..... 271/220
5,284,338 A * 2/1994 Allmendinger et al. ..... 271/220
5,478,062 A 12/1995 Horiuchi et al. ..... 270/53
6,065,748 A * 5/2000 Hutson ..... 271/222
6,126,164 A * 10/2000 Rennick et al. ..... 271/223
6,145,825 A 11/2000 Kunihiro et al. ..... 270/58.09
6,412,774 B1 * 7/2002 Saito et al. ..... 271/220

FOREIGN PATENT DOCUMENTS

JP 2000327207 A * 11/2000
JP 2001-019268 A 1/2001
JP 2001302068 A * 10/2001

* cited by examiner

*Primary Examiner*—Gene Crawford
*Assistant Examiner*—Leslie A Nicholson, III
(74) *Attorney, Agent, or Firm*—Ronald E. Prass, Jr.; Prass LLP

(57) ABSTRACT

In a finishing apparatus, as would be used with a printer or copier, sheets to be stapled are accumulated in a compiler tray. A set of pivotably-mounted fingers are pressed, by their own weight, against a top sheet as sheets enter the compiler tray. The mount on which the fingers are mounted can be moved to accommodate a growing stack and maintain a parallel contact between the fingers and the top of the stack. The even distribution of pressure from the fingers avoids curling or buckling of the sheets in the stack prior to stapling.

17 Claims, 3 Drawing Sheets

MECHANISM FOR RETAINING A STACK OF SHEETS IN A COMPILER TRAY, SUCH AS FOR AUTOMATIC STAPLING

TECHNICAL FIELD

The present disclosure relates to automated finishing apparatus, such as a stapling or binding apparatus, as would be used, for example, in a mid- or high-volume printer or copier.

BACKGROUND

The use of automated stapling devices is well known in the context of mid- or high-volume office equipment such as copiers and printers (hereinafter generically called "printers"). Typically, a stapling apparatus downstream of the engine of a printer includes a "compiler tray," which is a vertical or angled (i.e., non-horizontal) container for temporarily retaining sheets output from the printer. Associated with the compiler tray are any number of mechanisms for accepting or ejecting sheets in or from the container. As each multi-page document is output from the printer, the sheets thereof accumulate in the compiler tray. When the multi-page document ("set") is completely printed, the sheets accumulated in the compiler tray are stapled, and the stapled set is then ejected from the compiler tray.

In a typical arrangement of a compiler tray, there is an effective hard surface at the bottom of the tray, against which edges of sheets in the set are placed, mainly by gravity. The bottom surface acts as an aligning surface so that, just before a staple is driven into the set of sheets, the bottom edge of the set is properly aligned, resulting in a neat stapled set.

As a practical matter, particularly with large stapled sets, it becomes difficult to maintain an aligned edge of a set prior to stapling. Buckling of sheets within the compiler tray while sheets are being accumulated can result in an unsatisfactory stapled set.

PRIOR ART

U.S. Pat. No. 5,478,062 discloses a compiler tray having associated therewith a "pressing bar," which can hold a stack of sheets downward as the sheets accumulate.

U.S. Pat. No. 6,145,825 discloses a compiler tray having associated therewith a "pressing member," which can hold a stack of sheets downward as the sheets accumulate.

Japanese patent document number JP2001-019268A discloses a booklet maker in which sheets are accumulated in an "aligning tray." The aligning tray includes springably-mounted "presser members" which hold a bundle of sheets against a surface of the aligning tray.

SUMMARY

According to one aspect, there is provided a apparatus for collating sheets. A main surface contacts a bottom sheet of a stack of sheets, and a stop contacts an edge of the stack of sheets. At least one finger defines a main surface for substantially parallel contact with a top sheet of the stack of sheets. The finger is movably mounted on a mount, and the mount is movable relative to the stack to maintain substantially parallel contact of the finger with a top sheet of the stack of sheets, as the stack of sheets increases.

DETAILED DESCRIPTION

Figure 1:
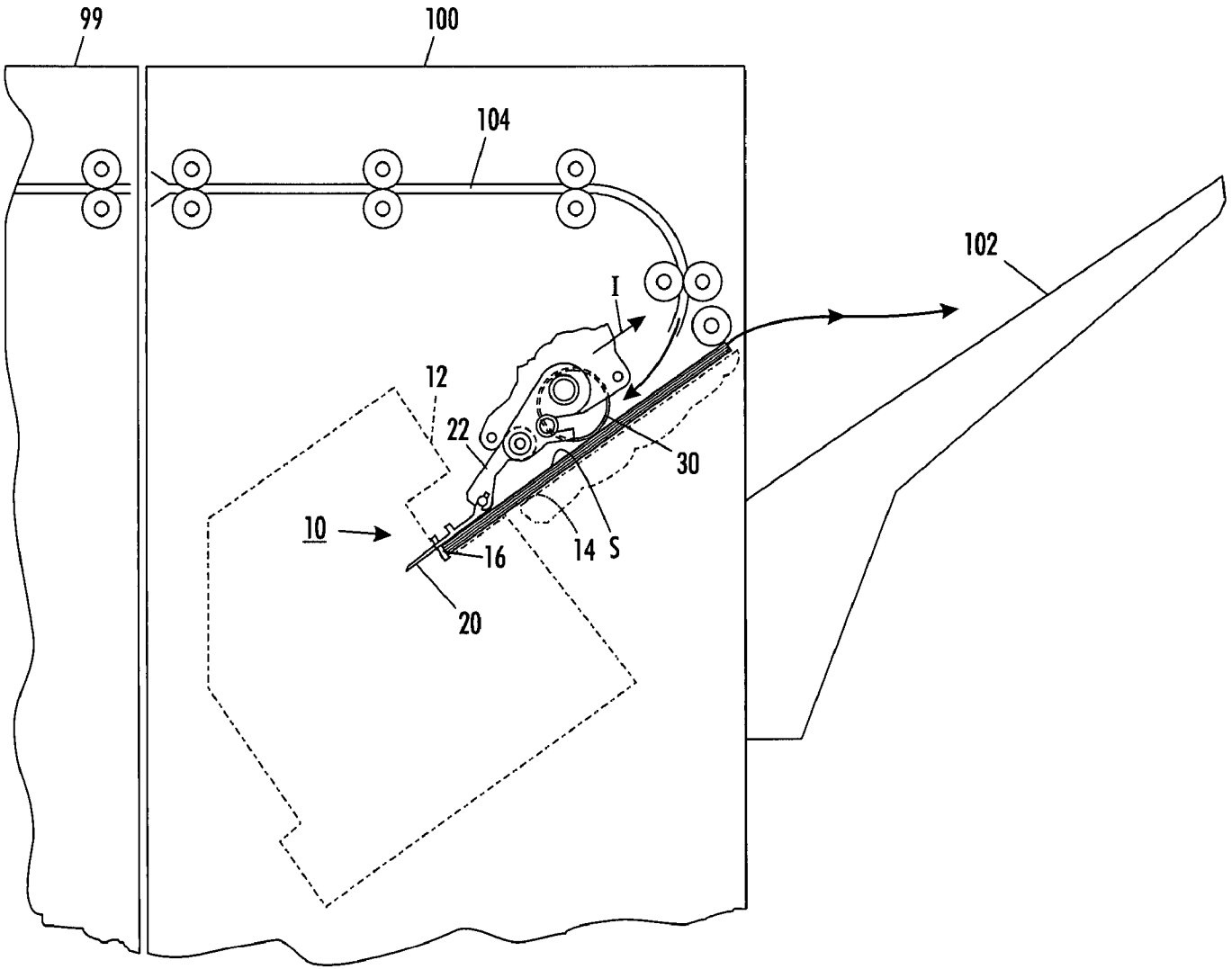
FIG. 1 is an elevational view of a compiler tray and associated mechanisms.

FIG. 1 is an elevational view of a compiler tray and associated mechanisms. Sheets are emitted one at a time from a copier or printer, partially shown as 99, and enter a finishing module generally indicated as 100. Although the finishing module 100 shown here is simply a collating and stapling device, other types of finishing module may include, for example, a hole-punching mechanism, a booklet maker, a C- or Z-folder, etc. In the finishing module 100, the sheets of a multi-page document emitted by the printer 99 are accumulated and stapled into a set, which is ejected into external catch tray 102. Catch tray 102 may have associated therewith a stacking elevator (not shown), as is generally known in the art.

When stapling or collating multi-page documents from printer 99, the sheets enter finishing module 100 and travel along a path 104 to be accumulated as a set in a compiler tray generally indicated as 10. Compiler tray 10 defines a main surface 14, for contact with a bottom side of a bottom sheet of a stack of sheets, such as shown as S. Disposed near a bottom of compiler tray 10 is a stapler, generally indicated as 12. The stapler 12 is positioned to place a staple in a stack of sheets, in a location generally near the bottom of the compiler tray. Compiler tray 10 need have only sufficient surfaces to temporarily retain a stack of sheets long enough to be stapled as needed; among these surfaces are a main surface 14 and at least one stop 16. The main surface 14 can be a substantially flat single surface, or can comprise ribs or other small structures which together act to support the stack S. Stop 16 contacts an edge of the stack of sheets S and maintains a straight edge of the stack, generally so that a straight-sided set of sheets is maintained prior to stapling.

In the illustrated embodiment, the main surface 14 of compiler tray 10 is sloped so that incoming sheets accumulate against stop 16 largely by gravity. However, in addition, sheets can be directed to and/or urged against stop 16 by urging means, such as including rollers, belts, or flappers as desired for maintaining, for instance, a suitable overall process speed. In the illustrated embodiment, a free-hanging, rigid compiler belt 30 urges sheets against stop 16 in a generally familiar manner. When such rollers, belts, flappers, etc., are used in compiler tray 10, the main surface 14 need not be sloped, but could be horizontal.

In a practical application, sheets from printer 99 which accumulate in compiler tray 10 are prone to buckle or bend within the space of the compiler tray, and when such bent sheets are stapled by stapler 12, the resulting stapled set is unsatisfactory in quality; the edges of the stapled stack, for example, may be crooked in one or more dimensions, or the staple does not sit neatly in the stack.

Figure 2:
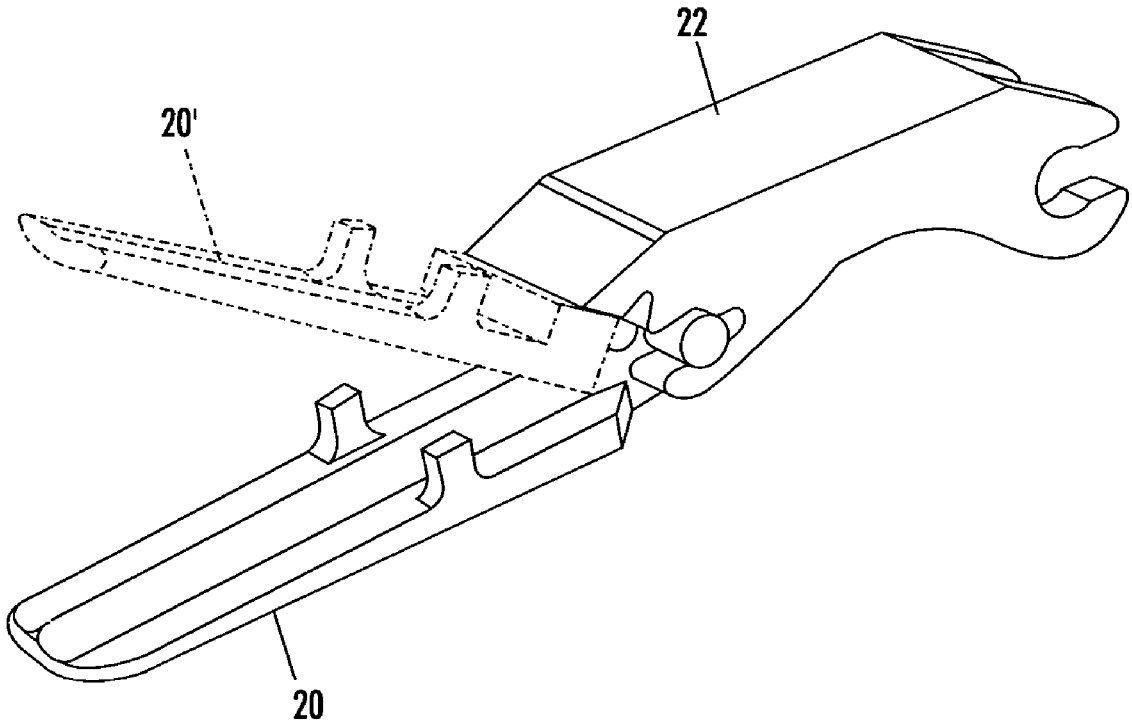
FIG. 2 shows a pivotably-mounted finger as used with the compiler tray of FIG. 1, in isolation.

To address the buckling problem, there is provided at least one finger 20, which is pivotably mounted on a mount 22 and disposed as shown toward the bottom of compiler tray 10. With reference to FIG. 2, which shows a finger 20 and associated mount 22 in isolation, it can be seen that finger 20 is loosely (i.e., not springably) mounted on the mount 22, and is allowed to move freely relative to the mount 22, as shown by the position of finger 20' in phantom. Returning to FIG. 1, it can be seen that finger 20 is placed on a top sheet of the stack of sheet S so that a main lower surface of the finger 20 maintains substantially parallel contact of the finger with a top sheet of the stack of sheets. As such, regardless of the size of stack S at any time, the weight of the finger 20 is distributed around a reasonably large area of the finger against the top sheet. In one embodiment, the downward pressure against the top of the stack S is provided substantially exclusively by the weight of one or more fingers 20.

Figure 3:
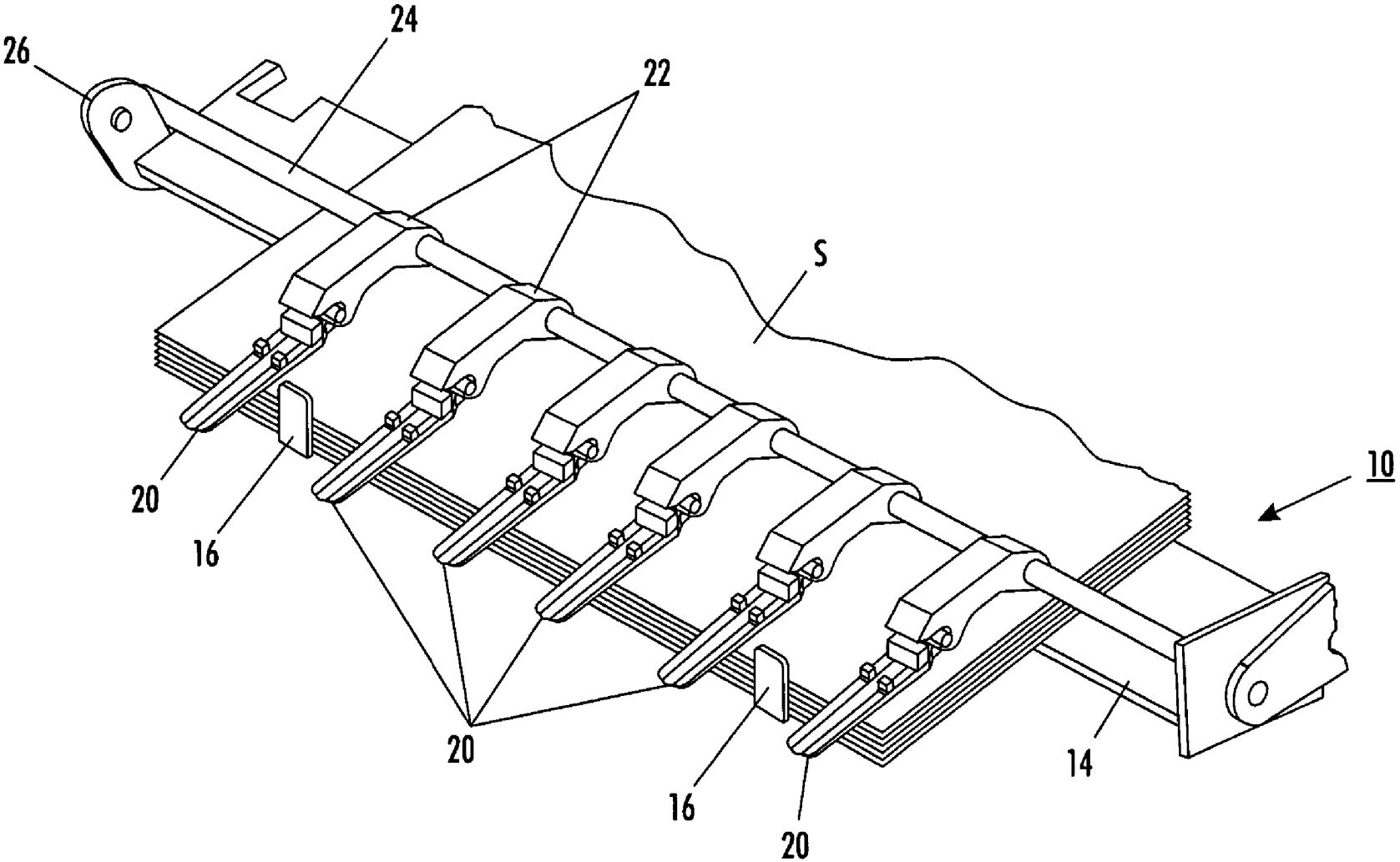
FIG. 3 is a perspective view showing a set of pivotably-mounted fingers, along with ancillary mechanisms.

Further, in this embodiment, finger 20 and mount 22 work together so that the substantially parallel contact of the finger 20 is maintained even as more sheets enter compiler tray 10 and the stack of sheets increases in size. FIG. 3 is a perspective view showing a set of pivotably-mounted fingers 20, along with their respective mounts 22 and ancillary mechanisms. A set of fingers 20 are arranged along an edge of stack S near the stops 16 (the stapler 12 is also adjacent this edge, but is not shown in this Figure). In this embodiment, the main surface of each finger 20 extends beyond the edge formed by stops 16.

Each finger 20 is pivotably mounted on an associated mount 22, and the mounts 22 are in turn rigidly mounted on an axle 24. Axle 24 is associated with a mechanism 26, which may be of any suitable mechanical design, and may be driven by a motor or solenoid (not shown) for its intended motion. As sheets accumulate in stack S, axle 24 can rotate and/or translate (such as shown in direction I in FIG. 1) to maintain the parallel relationship between each finger 20 and whatever sheet is on top of stack S at a given time. By providing a plurality of fingers 20 along one edge of stack S, buckling or curling of sheets in the stack is avoided along the entire length of the edge.

The avoidance of buckle in the stack of sheets on main surface 14 is dependent on how close the downward force of fingers 20 is from the driving force, from gravity and/or from urging means such as compiler belt 30, of sheets being urged against stop 16. The shorter the effective length that can buckle, the less prone the sheets are to buckle. At the same time, to control the effects of curl the fingers 20 should press down at the edge of the sheets, where the sheets touch the stop 16.

As shown in FIG. 3, stops 16, which can be disposed between pairs of fingers 20, can also be associated with a mechanism (not shown) for ejecting collated or stapled stacks S from the compiler tray to an output tray, such as 102 in FIG. 1.

Although the illustrated embodiment shows a finishing module for stapling a stack near an edge thereof, such as for corner or edge stapling, the embodiment can be adapted for a compiler tray useful in compiling signatures for folded booklets which are stapled along the fold thereof, or for other binding systems such as saddle-stitching or glue-binding.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. An apparatus for collating sheets, comprising:

a main surface, for contact with a bottom sheet of a stack of sheets, and a stop, for contacting an edge of the stack of sheets;

at least one finger, the finger defining a main surface for substantially parallel contact with a top sheet of the stack of sheets; and the finger being movably mounted on a mount, the mount being movable relative to the stack to maintain substantially parallel contact of the finger with a top sheet of the stack of sheets, as the stack of sheets increases, the substantially parallel contact of the finger being sufficiently large in area to prevent buckling of the stack of sheets.

2. The apparatus of claim 1, the finger being urged against the top sheet of the stack of sheets substantially exclusively by weight of the finger.

3. The apparatus of claim 1, the finger being not springably mounted on the mount.

4. The apparatus of claim 1, the finger being pivotably mounted on the mount.

5. The apparatus of claim 1, the mount being mounted on a rotatable axle.

6. The apparatus of claim 5, the mount being rigidly mounted on a rotatable axle.

7. The apparatus of claim 5, further comprising means for rotating the axle.

8. The apparatus of claim 1, the finger extending on the top sheet beyond the edge of the stack.

9. The apparatus of claim 1, comprising a plurality of fingers, each finger defining a main surface for substantially parallel contact with a top sheet of the stack of sheets.

10. The apparatus of claim 9, each finger being movably mounted on a mount.

11. The apparatus of claim 10, the mount being mounted on a rotatable axle.

12. The apparatus of claim 10, the mount being rigidly mounted on a rotatable axle.

13. The apparatus of claim 10, further comprising means for rotating the axle.

14. The apparatus of claim 1, further comprising a stapler suitable for stapling the stack of sheets when the stack of sheets contacts the stop.

15. The apparatus of claim 1, the stapler being disposed to place a staple in the stack near the stop.

16. The apparatus of claim 1, further comprising ejection means for ejecting a stack of sheets relative to the stop.

17. The apparatus of claim 1, further comprising urging means for urging the stack of sheets against the stop.

* * * * *